US007195131B2

(12) United States Patent
Bryant

(10) Patent No.: US 7,195,131 B2
(45) Date of Patent: Mar. 27, 2007

(54) DRUM CLOSURE

(75) Inventor: James Bryant, Madison Heights, VA (US)

(73) Assignee: Framatome ANP, Inc., Lynchburg, VA (US)

( * ) Notice: Subject to any disclaimer, the term of this patent is extended or adjusted under 35 U.S.C. 154(b) by 43 days.

(21) Appl. No.: 10/665,676

(22) Filed: Sep. 19, 2003

(65) Prior Publication Data

US 2005/0061817 A1 Mar. 24, 2005

(51) Int. Cl.
*B65D 48/16* (2006.01)

(52) U.S. Cl. ..... 220/325; 292/256; 292/256.73; 24/486; 403/290; 269/249

(58) Field of Classification Search ..... 220/325, 220/327, 324; 292/256.73, 258, 288, 291, 292/256.5; 24/486; 403/290, 289, 374.3; 269/249; 248/316.1, 226.11; 27/DIG. 1; 285/406

See application file for complete search history.

(56) References Cited

U.S. PATENT DOCUMENTS 1,008,146 A * 11/1911 Herriman ..... 292/256.5
1,059,747 A * 4/1913 Montross ..... 27/17
1,150,843 A * 8/1915 Draper ..... 220/319
1,331,005 A * 2/1920 Duncan ..... 220/573.1
1,362,878 A * 12/1920 Ladd ..... 220/4.03
1,450,687 A * 4/1923 Kunin ..... 292/258
1,480,782 A * 1/1924 Primeau ..... 220/319
1,780,534 A * 11/1930 Peterson ..... 220/256.1
1,864,313 A * 6/1932 Monson ..... 220/327
1,924,027 A * 8/1933 Clark ..... 27/17
1,941,294 A * 12/1933 Eck et al. ..... 292/256.71
1,965,898 A * 7/1934 Kollinger ..... 220/318
1,988,589 A * 1/1935 Gaston ..... 220/325
2,025,932 A * 12/1935 Beldin ..... 220/495.11
2,246,470 A * 6/1941 McArn et al. ..... 292/256.71
2,357,246 A * 8/1944 Whitmyer ..... 206/524.2
2,410,214 A * 10/1946 Higginson et al. ..... 220/254.3
2,420,411 A * 5/1947 Blount, Sr. ..... 220/325
2,523,760 A * 9/1950 Hayner ..... 292/256.75
2,736,083 A * 2/1956 Rogers ..... 27/35
2,837,063 A * 6/1958 Martinez ..... 403/288
3,632,014 A * 1/1972 Basile ..... 220/203.29
4,411,372 A * 10/1983 Basterfield et al. ..... 220/327
4,589,643 A * 5/1986 Breum ..... 220/4.12
4,632,272 A * 12/1986 Berenfield et al. ..... 220/324
4,690,298 A * 9/1987 Schepers ..... 220/325
4,846,431 A * 7/1989 Pflieger ..... 248/228.4
4,901,963 A * 2/1990 Yoder ..... 24/489
5,118,144 A * 6/1992 Garofalo, Jr. ..... 292/87
5,131,780 A * 7/1992 Love ..... 403/290
5,228,739 A * 7/1993 Love ..... 296/100.02
5,301,913 A * 4/1994 Wheatley ..... 248/231.41
RE34,739 E * 9/1994 Nelson et al. ..... 126/113
5,346,090 A * 9/1994 Purohit et al. ..... 220/23.87
5,373,959 A * 12/1994 Haasewinkel ..... 220/324
5,462,322 A * 10/1995 Berezansky ..... 292/288
5,586,373 A * 12/1996 Eby et al. ..... 24/525

(Continued)

*Primary Examiner*—Anthony D. Stashick
*Assistant Examiner*—James Smalley
(74) *Attorney, Agent, or Firm*—Kenyon & Kenyon LLP

(57) ABSTRACT

A drum closure which establishes a connection between the body of a drum and lid, wherein the connection will prevent separation of the lid from the body under severe loading conditions such as dropping the drum from a height of thirty (30) feet.

7 Claims, 1 Drawing Sheet

U.S. PATENT DOCUMENTS 5,657,892 A * 8/1997 Bolli et al. ..... 220/325
5,704,664 A * 1/1998 Naumovski ..... 292/288
5,732,844 A * 3/1998 Zorzini ..... 220/325
5,765,902 A * 6/1998 Love ..... 296/100.01
6,435,576 B1 * 8/2002 Kusta ..... 292/256.67
2002/0131818 A1 * 9/2002 Wang et al. ..... 403/290

* cited by examiner

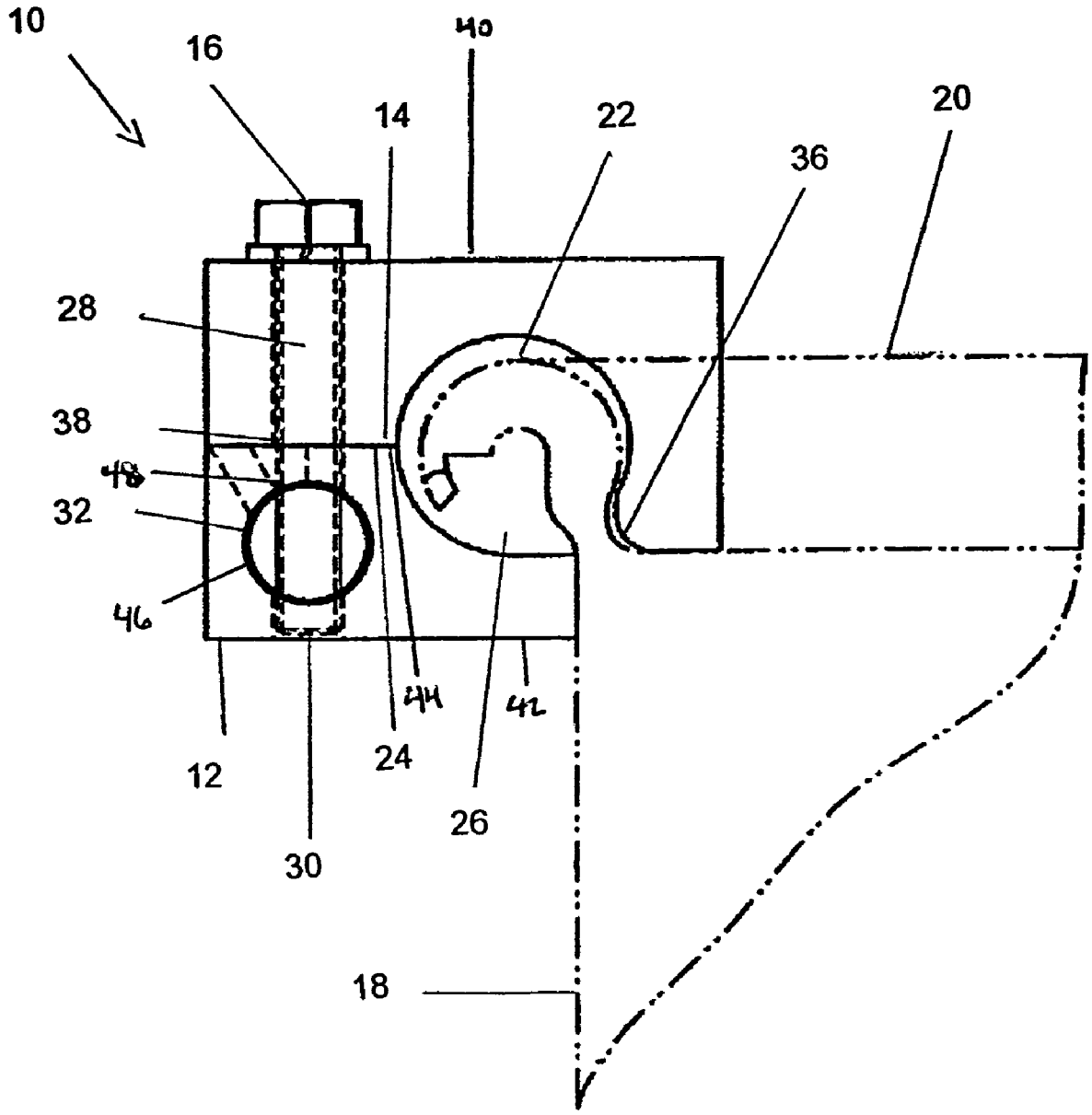
10
16
40
14
22
20
36
28
38
48
32
46
12
30
24
44
42
26
18

DRUM CLOSURE

FIELD OF THE INVENTION

The present invention relates to drum closures. More specifically, the present invention relates to a drum closure which prevents separation of a drum lid from a drum body under accident conditions, such as dropping a drum unit from thirty (30) feet in elevation.

BACKGROUND INFORMATION

Drums provide a mechanism by which materials, such as solids and/or liquids are housed. The housing may be for a limited duration, or, as in the case of nuclear waste storage, for extended time periods, up to and often exceeding years in duration. The drums have drum closures which allow the entire drum unit (i.e. the drum body and lids) to be sealed in order to prevent spilling or escape of drum contents.

Drums come in various sizes, such as, for example, 55 gallon capacities. Under conditions where the interior contents are not volatile and the drum is not moved, the drum is sealed by placing a lid on a lip of the drum body. The lid is then press fitted into the opening of the drum body. This type of seal is economical to produce, however, the resulting connection between the drum body and the lid is not structurally rugged. During a tipping of the drum, contents may escape as the body and lid may separate. If the drum is subjected to an accident, such as dropping the drum from a height of thirty (30) feet, the drum and lid separate causing the contents to exit the drum.

To prevent escape of drum contents, in the exemplary case of a hazardous material drum, drum closures attempt to seal the drum body and lid into a single unit, thereby preventing escape of drum contents. Such drum closures may be configured as split closure rings which attempt to fasten the lid to the drum head through tightening lugs which compress the ends of the rings together. These closures, however, have been found to be inadequate for accident scenarios postulated for drum designs for use in, for example, nuclear material storage. Due to changing regulations regarding postulated accident scenarios for this type of storage, these drum closures must now be designed and configured to withstand both postulated puncture type accidents and high elevation drop accidents. Although structurally superior to standard drum closures, the current hazardous material drum closure designs still do not provide sufficient closure strength for severe accidents including puncture and dropping the drum from thirty (30) feet.

There is a need for a drum closure design and configuration which will withstand severe accident forces and prevent drum contents from spilling or escaping from the drum.

There is a further need for the drum closure to be economical and easily installed on existing drum designs.

There is a further need for the drum closure to resist puncture accidents as well as blunt impact accidents.

SUMMARY

It is an object of the present invention to provide a drum closure which will withstand severe accident forces and prevent drum contents from spilling or escaping from the drum.

It is a further object of the present invention to provide a drum closure that is economical and easily installed on existing drum designs.

It is a further object of the present invention to provide a drum closure which resists puncture accidents as well as blunt impact accidents.

These and other objects of the invention, which will become apparent from the following detailed description, are achieved as described. The invention provides a top clamp configured with a top surface and a bottom surface and at least one threaded top clamp bolt hole extending through the top clamp. The invention also provides a base clamp configured with a bottom surface and at least one threaded base clamp bolt hole extending through the base clamp. The invention further provides a bolt inserted through the top clamp bolt hole and the base clamp hole which is configured to extend from a secured position to an unsecured position, wherein the bottom surface of the top clamp and the top surface of the base clamp are configured to form in unison a lip holding area for a drum and the top clamp and base clamp are configured to be inserted around a portion of a drum lid and drum body interface to secure the drum lid to the drum body, the base clamp configured to rotate from the top clamp in the unsecured position.

The invention also provides a method for closing a drum. The method for closing a drum comprises providing three drum closure arrangements, and positioning a top clamp of each of the three drum closure arrangements on a drum lid interface. The method further provides for positioning a base clamp of each of the three drum closure arrangements on the drum lid interface and inserting a bolt through the top clamp into the base clamp. Lastly, the method provides for tightening the bolt inserted through the top clamp into the base clamp such that the top clamps and the base clamps form a lip holding area.

BRIEF DESCRIPTION OF THE DRAWINGS

A better understanding of the present invention may be had from consideration of the detailed description taken in conjunction with the following drawing:

FIG. 1 is a side view of a drum closure according to the present invention.

DETAILED DESCRIPTION

FIG. 1 illustrates a drum closure 10 in conformance with the present invention. The drum closure 10 provides a top clamp 14, a base clamp 12 and a bolt 16. The top clamp 14 has a top surface 40 and a bottom surface 24. The base clamp 12 is configured with a bottom surface 42. The top clamp 14 and the base clamp 12 may be assembled in unison to provide a lip holding area 26 configured, for example, to hold an interface between a drum lid 20 and drum body 18. The top clamp 14 may be joined to the base clamp 12 through use of the bolt 16 which is placed in a bolt hole 38 which extends through the top clamp 14 and base clamp 12 when the respective top clamp 14 and base clamp 12 are arranged in unison. A unified arrangement may be defined as placement of the bottom surface 24 of the top clamp 14 with a top surface 44 of the base clamp 12 such that the respective holes in the top surface 40 in the top clamp 14 and the base clamp 12 produce the bolt hole 38.

The top clamp 14 may be tightened to the base clamp 12 by torquing the bolt 16 arranged in the bolt hole 38. The bolt hole 38 may have either a threaded interior surface or a smooth surface. In the case of a smooth surface, the bolt 16 may penetrate the bottom of the base clamp 12 to allow a nut to be installed on the bolt 16 to allow tightening. In the case of a threaded surface, any number of threads per unit length may be chosen to match the threads of the bolt 16. The threads of the bolt hole 38 may be made of the same material as the threads of the bolt 16 to prevent galvanic reaction between the bolt 16 and the clamps 12 and 14. The bolt hole 38 may also extend completely through the top clamp 14 and base clamp 12 such that a bottom nut may be used to torque the top clamp 14 to the base clamp 12.

The top clamp 14 may be configured in a generally rectangular configuration with a cut out area and a rounded knuckle 36 which may be configured to bindingly fit into a top surface of a lid 20 of a drum. As illustrated, the top clamp 14 may be pressed into the corresponding shape of the drum lid 20 to establish a contact surface with the lid 20. The length of contact may be varied by choosing the length of the top clamp 14 for a desired length. The top clamp 14 and the base clamp 12 may be sufficiently configured to fit the circumferential profile of the lid 20 to which the clamps 12, 14 are to be installed on. The top clamp 14 may also have a hardened top surface 40 to allow the bolt 16 to be torqued on top clamp 14 without marring the material of the top clamp 14. The top surface 40 may also be inscribed with information such as material types, to allow quick identification of materials of the drum closure 10.

The base clamp 12 may be configured with the bolt hole 38 and a penetration 32. The bolt hole 38 and the penetration 32 may be configured in any geometry desired, as the geometry illustrated is merely exemplary. The base clamp 12 may be configured in the shape of the rectangular block with a semi-circular section removed to establish a boundary for the lip holding area 26. A fitting 46 may be installed in the penetration 32. The fitting 46 may be configured with, for example, a hole 48 with threads made to accept insertion of the bolt 16 extending from the top clamp 14. The hole 48 of the fitting 46 may be made with any size threads to allow acceptance of the bolt 16. As illustrated, the bolt 16 may penetrate the fitting 46 or the bolt 16 may partially penetrate the fitting 46. The fitting 46 may be made of material to match the bolt 16 to prevent galvanic reaction between the fitting 46 and the bolt 16. The fitting 46 may extend through the length of the base clamp 12 or may be a partial length unit.

The bolt 16 may be any diameter desired by the user, for example a 5/16 inch unit. The bolt may be configured with a hexagonal head or any other head that will allow a torquing and de-torquing of the bolt 16. The bolt 16 may be constructed from stainless steel or other non-corrosive material.

The lip holding area 26 may be configured in a semi-circular area as illustrated or maybe shaped in other geometric configurations. The top clamp 14, the base clamp 12 and the bolt 16 may be constructed of non-corrosive material, such as stainless steel to retard or prevent corrosion from occurring. The top clamp 14, base clamp 12 and bolt 16 may additionally be made of a material identical to that of the drum such that galvanic reaction between differing materials is eliminated.

To remove the drum closure 10, the bolt 16 is de-torqued causing the bolt 16 to rise from the fitting 46. The bolt 16 may then be continued to be loosened such that the base clamp 12 may be rotated from the top clamp 14 and the top clamp 14 and base clamp 12 subsequently removed.

In operation three drum closure units, for example, may be positioned on a drum lid interface 22 to allow for closure of a drum body 18 to a drum lid 20. The method provides three drum closure arrangements wherein a top clamp 14 of each of the three drum closure arrangements are placed on the drum lid interface 22. Next, a base clamp 12 for each of the drum closure arrangements are placed such that the bolt hole 38 from the top clamp 14 of each of the drum closure arrangements corresponds to a bolt hole of each of the base clamps 12 for the respective arrangements. Next, a bolt 16 is inserted through the top clamp 14 into the base clamp 12. The bolt 16 is then tightened such that the top clamp 14 and the base clamp 12 of each of the respective drum closure arrangements are torqued from an unsecured position to a secured position to provide for a seal of the drum lid interface 22. The drum closure 10 may be removed from the drum by de-torquing the bolt 16 from the secured position to the unsecured position and rotating the base clamp 12.

The configuration presented above was tested by subjecting a drum with three closure arrangements to a thirty (30) foot free drop onto an unyielding target at an angle of approximately 17.5 degrees from the horizontal. The impact point was on the closure ring directly opposite from the ring closure bolt. This specimen did not show signs of lid separation after the thirty (30) foot drop test. The lid remained engaged.

The configuration was then subjected to three puncture tests. For each puncture test, the package impacted the puncture pin on the drum closure ring. The first test impacted at the closure bolt, the second at the point where the closure ring was least engaged due to the drop test and the third onto the lip clamp. In all tests, the ring, bolt and lid clamps remained undamaged and secured.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are accordingly to be regarded in an illustrative rather than a restrictive sense.

What is claimed is:

1. A drum closure, comprising:

a top clamp configured with a top surface and a bottom surface and at least one threaded top clamp bolt hole extending through a body of the top clamp;

a base clamp configured with a bottom surface and at least one threaded base clamp bolt hole extending through a body of the bottom surface; and a bolt inserted through the top clamp bolt hole and the base clamp bolt hole and configured to extend from a secured position to an unsecured position, wherein the bottom surface of the top clamp and the top surface of the base clamp are configured to form in unison a lip holding area for a drum and the top clamp and base clamp are configured to be inserted around a portion of a drum lid and drum body interface to secure the drum lid to the drum body, the base clamp configured to rotate from the top clamp in the unsecured position, wherein the base clamp has a fitting inserted into the base clamp to accept and secure the bolt, wherein the base clamp has a separate penetration from the base clamp hole, the separate penetration housing the fitting wherein the lip holding area is configured in an approximately circular geometry, wherein the top clamp has a rounded knuckle on the bottom surface, the rounded knuckle configured to abut a drum lid body interface.

2. The drum closure according to claim 1, wherein the top clamp, the base clamp and the bolt are made of non-corrosive material.

3. The drum closure according to claim 2, wherein the non-corrosive material is stainless steel.

4. The drum closure according to claim 1, wherein the bolt is less than 1 inch in diameter.

5. The drum closure according to claim 1, wherein the top clamp is configured with a hardened seat around the at least one threaded top clamp bolt hole.

6. A method of closing a drum, comprising:

providing three drum closure arrangements;

positioning a top clamp with a rounded knuckle on a bottom surface of each of the three drum closure arrangements on a drum lid interface;

positioning a base clamp of each of the three drum closure arrangements on the drum lid interface;

inserting a bolt through the top clamp into the base clamp; and tightening the bolt such that the top clamps and the base clamps form a lip holding area wherein the bolt enters into the base clamp and is captured by a fitting provided in the base clamp, wherein the base clamp has a separate penetration from the base clamp hole, the separate penetration housing the fitting for the bolt and the positioning of the top clamp and the base clamp provides a lip holding area that is configured in an approximately circular geometry to secure the drum.

7. The method of closing a drum according to claim 6, wherein the top and base clamps are positioned over a drum closure ring.

* * * * *